US006247503B1

(12) United States Patent
Shaw et al.

(10) Patent No.: US 6,247,503 B1
(45) Date of Patent: Jun. 19, 2001

(54) DRIVE FOR A MECHANICAL LOOM

(75) Inventors: Henry Shaw, Steenvoorde (FR); Marc Adriaen, Hollebeke; Walter Bilcke, Geluveld, both of (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/341,124

(22) PCT Filed: Jan. 13, 1998

(86) PCT No.: PCT/EP98/00133

§ 371 Date: Aug. 16, 1999

§ 102(e) Date: Aug. 16, 1999

(87) PCT Pub. No.: WO98/31856

PCT Pub. Date: Jul. 23, 1998

(30) Foreign Application Priority Data

Jan. 14, 1997 (BE) ..... 9700033

(51) Int. Cl.[7] ..... D03D 51/02
(52) U.S. Cl. ..... 139/1 E; 139/1 R
(58) Field of Search ..... 139/1 E, 1 R

(56) References Cited

U.S. PATENT DOCUMENTS

| | | | | |
|---|---|---|---|---|
| 4,476,899 | * | 10/1984 | Schwarz et al. | 139/1 E |
| 4,874,018 | * | 10/1989 | Van Bogaert et al. | 139/1 E |
| 5,617,901 | * | 4/1997 | Adriaen et al. | 139/1 E |
| 5,642,757 | * | 7/1997 | Froment et al. | 139/1 E |

* cited by examiner

*Primary Examiner*—Andy Falik
(74) *Attorney, Agent, or Firm*—Bacon & Thomas PLLC

(57) ABSTRACT

A drive for a mechanical loom. The drive includes a main drive shaft (2) that is mounted in a machine frame (1) and is driven by a drive motor (5) which is disposed coaxially to the main drive shaft (2) and directly connected thereto. The main drive shaft (2) is preferably designed as a motor shaft for the drive motor (5).

13 Claims, 9 Drawing Sheets

DRIVE FOR A MECHANICAL LOOM

BACKGROUND OF THE INVENTION

1. Field of the Invention

The invention relates to a loom drive system comprising a main drive shaft supported in a loom frame and driven by a drive motor.

2. Description of the Related Art

A loom drive system is known from the European patent document A 0,726,345 comprising a main'drive shaft supported in the loom frame and driven through transmission elements, for instance a belt system, by a drive motor. The main drive shaft is fitted with a switching gear wheel which, in a first position, engages both a gear to drive at least one batten and a gear to at least drive shed forming means and which, in such second position, engages only one of the said two gears. The switching gearwheel and the main drive shaft are non-rotatably connected to each other by spline connections, so that the switching gear wheel can be axially shifted relative to the main drive shaft while being connected without play in the circumferential direction to the main drive shaft This play-free circumferential connection is required to enable varying the transmitted drive torque between positive and negative values. A clutch and/or a switched brake may be inserted in the connection between the drive motor and the main drive shaft. For gripper looms, the first gear moreover may power a gripper drive. During normal, fast weaving and during slow operation the switching gear wheel engages both gears, whereas during the so-called filling-search, the switching gear wheel is disengaged from the first gear and is only engaged with the second gear. During slow operation and during a filling search, the main drive motor is operated at a lesser speed than during normal weaving. Alternatively, in such a case a slow motor may provide the drive power.

SUMMARY OF THE INVENTION

The objective of the invention is to improve a drive system of the initially cited kind.

This problem is solved by mounting the drive-motor shaft coaxially with the main drive shaft and connected directly to it.

Because of this configuration, the overall assembly is more compact, requiring less installation space. Furthermore the transmission elements between the drive motor and the main drive shaft are eliminated, thereby eliminating the energy losses caused by such transmission elements.

In an especially advantageous embodiment of the invention, the main drive shaft functions also as the shaft of the drive-motor. Again, compactness is achieved thereby, and at the same time energy losses are reduced further. Transmission elements are absent that would cause energy losses between the drive motor and the main drive shaft. Also bearings for the main drive shaft, that is for the drive motor shaft, may be eliminated, and energy losses are cut still further.

In another embodiment of the invention, the main drive shaft is supported so as to allow its axial displacement and is adjustable, by shifting devices, between a first and a second position, and this axially displaceable main drive shaft is fitted with a switching gear wheel affixed to it both circumferentially and axially, said switching gear wheel when in a first position engaging at least two gears and when in a second position engaging only one gear powering drive systems. Such a main drive shaft may be substantially manufactured on a lathe and accordingly with tight tolerances and economically. The switching gear wheel present on the main drive shaft moreover may be manufactured so as to be integral with the main drive shaft or it may be mounted in a known manner on the main drive shaft. When the switching gear wheel is rigidly attached both axially and circumferentially to the main drive shaft, special manufacturing procedures known in the prior art for ensuring accurate manufacture of axial toothings between the main drive shaft and the switching gear wheel that would permit the switching gearwheel to be axially shifted on the main drive shaft while avoiding play in the circumferential direction are avoided.

In a further embodiment of the invention, the main drive shaft is supported by roller bearings including an outer race and rollers which engage the main drive shaft. Such bearings offer the advantages of containing only a small number of parts and permitting axial shifting of the main drive shaft.

In a further embodiment of the invention, a drive motor rotor is mounted on the main drive shaft and togetherwith the shaft is axially displaceable relative to an associated stationary stator. This configuration allows easy connection of the rotor to the main shaft. Preferably the longitudinal centers of the rotor and the stator will be located substantially in a common radial plane for permitting the main drive shaft to engage both drive elements. This provides the advantage that, when the drive motor is energized, the stator will not exert axial, electromagnetic forces on the rotor. As a result, the main drive shaft will not be shifted to a different position during weaving due to movement induced by electromagnetic forces. The rotor and stator are approximately the same axial length and the rotor is thus constrained by a substantially large axial force to remain at a defined position relative to the stator. Accordingly the main drive shaft is kept in a position during normal weaving from which it will neither move axially nor oscillate.

In a preferred embodiment, the angular speed and/or the angular position and/or the drive torque and/or the direction of rotation of the drive motor shall be controlled. As a consequence, the main drive shaft can be powered at a particular desired speed and direction of rotation using only one drive motor.

Further features and advantages of the invention are revealed in the following description and drawings, showing illustrative embodiments.

DETAILED DESCRIPTION OF THE PREFERRED EMBODIMENTS

Figure 1:
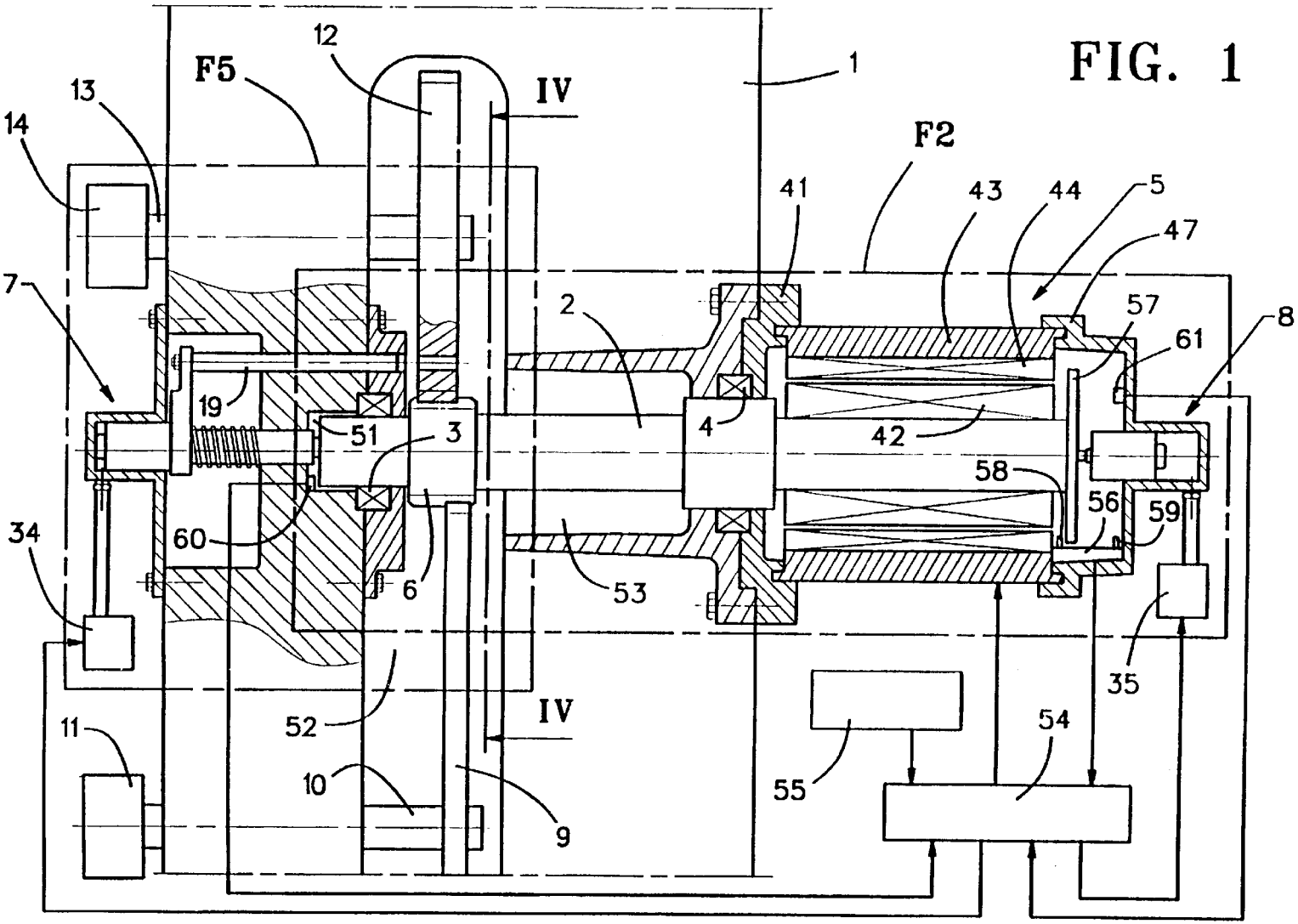
FIG. 1 is a partly sectional schematic elevation view of a loom drive system according to the invention.

As regards the loom drive system shown in FIGS. 1 through 5, a main drive shaft 2 is supported by roller bearings 3, 4 in a frame of a loom. The main drive shaft 2 is powered for example by an electric drive motor 5. The main drive shaft 2 is fitted with a switching gear wheel 6 comprising a spur gear. The switching gear wheel 6 may be made integrally with the main drive shaft 2 or it may be non-rotatably affixed on the latter as a separately manufactured element.

The switching gear wheel 6 engages a drive gear 9 fitted with spur teeth and connected by a shaft 10 to drive elements 11. Illustratively the drive elements 11 are shed driving means consisting of a dobby, a cam box, a Jacquard machine or arbitrary other shed-forming devices. The drive elements 11 simultaneously may also be used to drive selvage forming means and to positively drive a whip roll. Moreover the switching gear wheel 6 engages a straight, spur-type drive gear 12 connected by a shaft 13 to second drive elements 14. These further drive elements 14 illustratively are the batten drive means and in the case of a gripper loom, they drive the gripper devices or gripper bands. The second drive elements 14 also can be used to drive selvage tuck-in devices, cloth spooling and waste-winding devices. In the embodiment shown, the main drive shaft 2 and the shafts 10 and 13 all extend parallel.

To limit the torque applied by the main drive shaft 2, the diameter of the switching gear wheel 6 is made smaller than that of the drive gears 9 and 12. The drive gear 12 is connected to the drive elements 14 by the shaft 13 comprising the batten drive and preferably rotates at one revolution per filling insertion. The drive gear 9 is connected by the shaft 10 to the first drive elements 11 comprising the shed-forming drive means and rotates for instance only by half a revolution for one revolution of the drive elements 14 because the shed-forming means need only pass through half a cycle per filling insertion. Therefore, the diameter of the drive gear 9 may be twice that of the drive gear 12.

Figure 2:
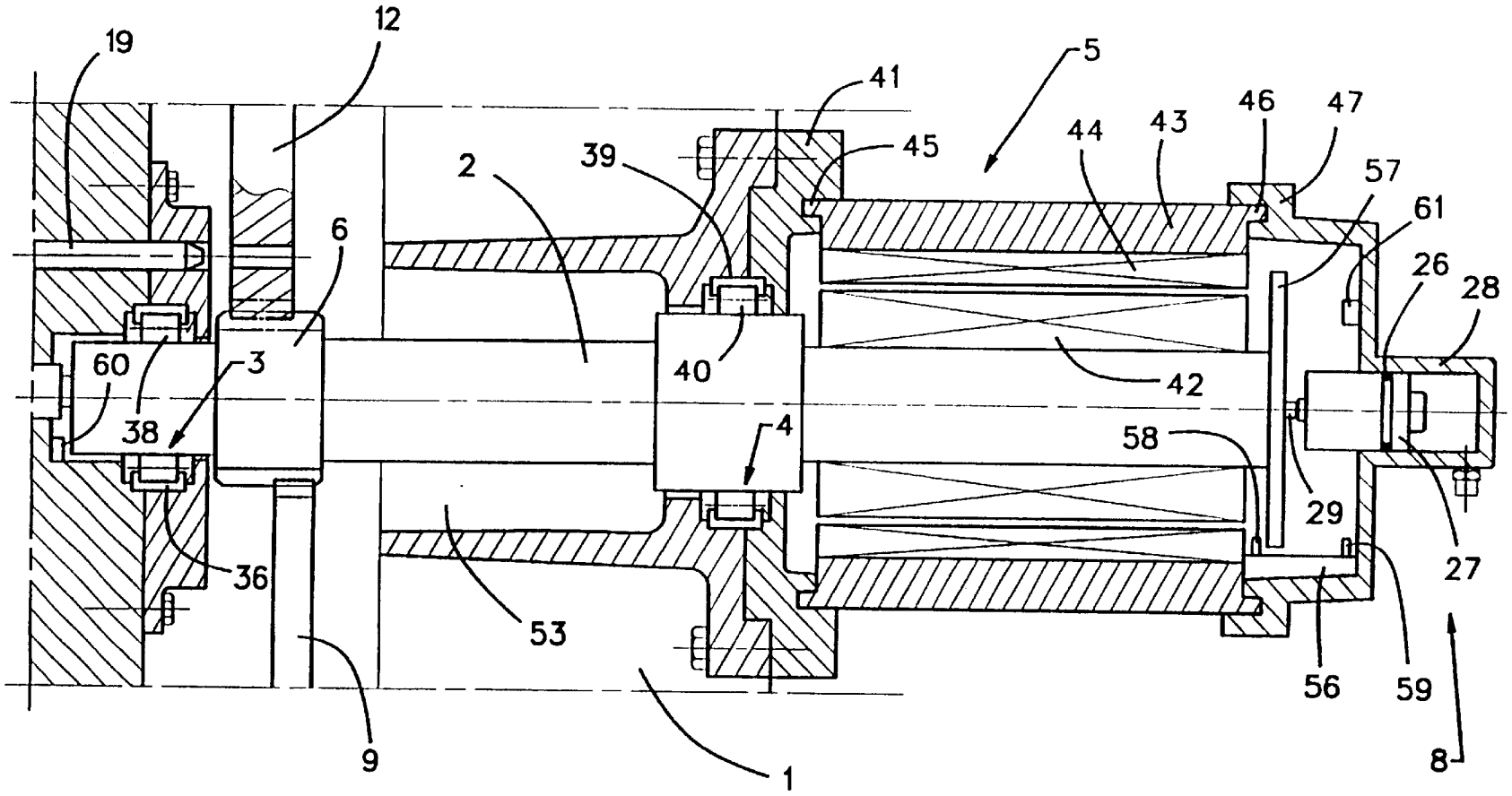
FIG. 2 shows detail F2 of FIG. 1 on an enlarged scale.
Figure 3:
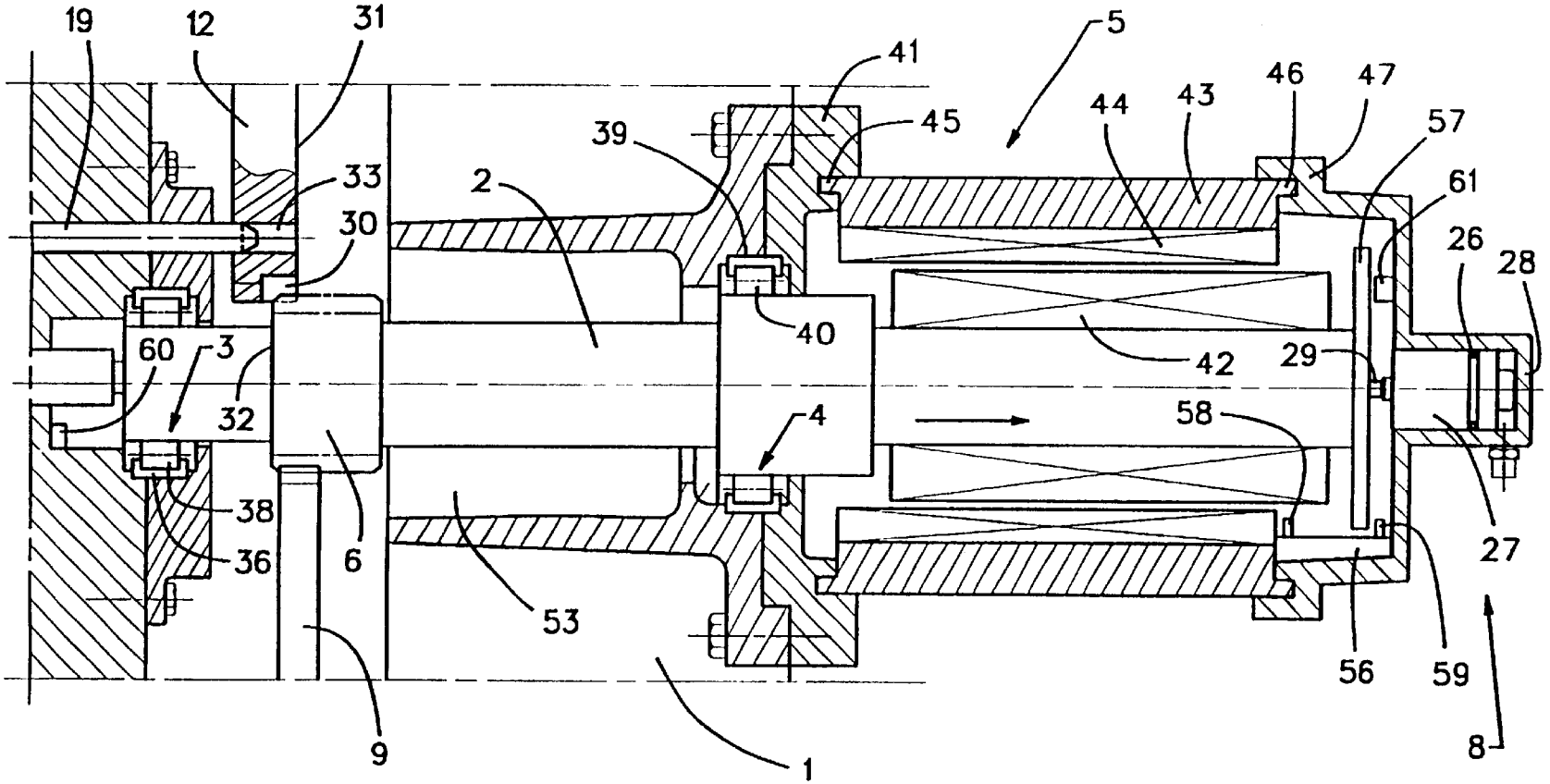
FIG. 3 is similar to FIG. 2 for a different position of the main drive shaft.

In a first position shown in FIGS. 1 and 2 and wherein the loom while weaving is powered by the main drive shaft 2, the switching gear wheel 6 engages the two drive gears 9 and 12 and as a result these drive gears 9 and 12 are powered by the main drive shaft 2. Following loom stoppage, when the drive elements 14 must be separated from the main drive shaft 2 forthe purpose of carrying out a so-called filling search motion, the main drive shaft 2 together with the switching gearwheel 6 is axially shifted into a second position as shown in FIG. 3. In this position the switching gear wheel 6 remains engaged with the drive gear 9, however it is disengaged from the drive gear 12 and as a result only the drive gear 9 will still be powered by the main drive shaft 2.

Shifting devices 7, 8 are used to axially displace the main drive shaft 2. The shifting device 7 comprises a rod 16 fitted with a hook 17 and a fitting 18. A further rod 19 is mounted on the fitting 18. The end of the rod 16 opposite the hook 17 acts as a piston 21 guided inside a cylinder 22 and fitted with a piston seal 20, for instance an O ring. The cylinder 22 is connected to an hydraulic control device 34 (FIG. 1) that may correspond to the control device in the European patent document A 0,726,345, or it may be a pneumatic control device which may displace the rod 16 in one direction, that is toward the main drive shaft 2. A return spring 23 is provided to move the rod in the opposite direction. The hook 17 is mounted eccentrically of the rod and of the axis of the main drive shaft 2 and, as a result, the hook can enter an undercut clearance 24 or slot in the main drive shaft 2. The rod 16 furthermore cooperates with a wear-resistant pin 25 attached, for instance by threads, into the main drive shaft 2. By axially displacing the bolt 16, the main drive shaft 2 in turn is displaced axially. As shown in FIGS. 2 and 3, the shifting device 8 contains a piston 27 fitted with a sealing ring 26, for instance an 0 ring, and guided inside the cylinder 28. The piston 27 cooperates with a wear-resistant pin 29 which is fixed, for example by threads into the main drive shaft 2. The cylinder 28 like the cylinder 22 can be actuated by a corresponding control device 35 (FIG. 1). Even though the shifting device 8 is not mandatory because the shifting device 7 is able to displace the main drive shaft 2 in both directions, nevertheless the pair of shifting devices 7, 8 is preferred because in such a design the two pins 25 and 29 limit the axial excursion of the main drive shaft 2. An appropriate slight play is left in the vicinity of the pins 25, 29 to secure, by these mechanical elements, the main drive shaft 2 against undesired axial slippage.

Figure 4:
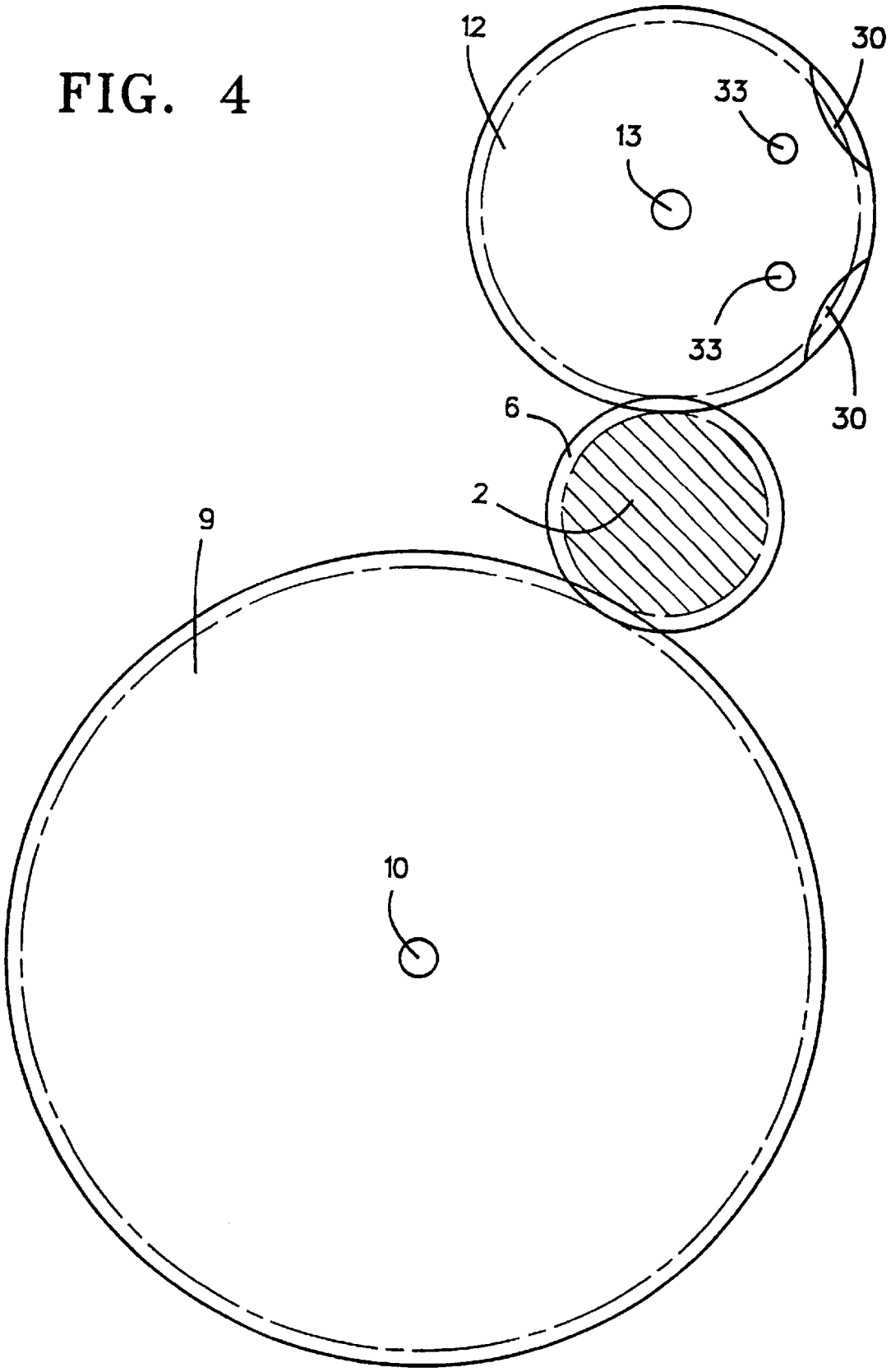
FIG. 4 is a partial section view taken along line IV—IV of FIG. 1 on an enlarged scale showing the mutual configuration of the drive gears.

As shown in FIGS. 3 and 4, the teeth of the drive gear 12 include a clearance 30 extending over at least part of the axial length of the gear in order that, at the position shown in FIG. 3, the drive gear 12 can be disengaged from the switching gear wheel 6 even though the side flank 31 of the gear 12 and the side flank 32 of the switching gearwheel 6 are overlapping. As shown by FIG. 3, the switching gearwheel 6 rotates freely relative to the drive gear 12 in that position. Accordingly the drive gear 12 may be made comparatively wide without the need to axially displace the main drive shaft 2 over a correspondingly large distance in order to disengage the switching gear wheel 6 from the drive gear 12. Preferably the teeth of the switching gear wheel 6 are beveled at the side flank 32 facing the drive gear to facilitate engagement with the drive gear 12.

Figure 5:
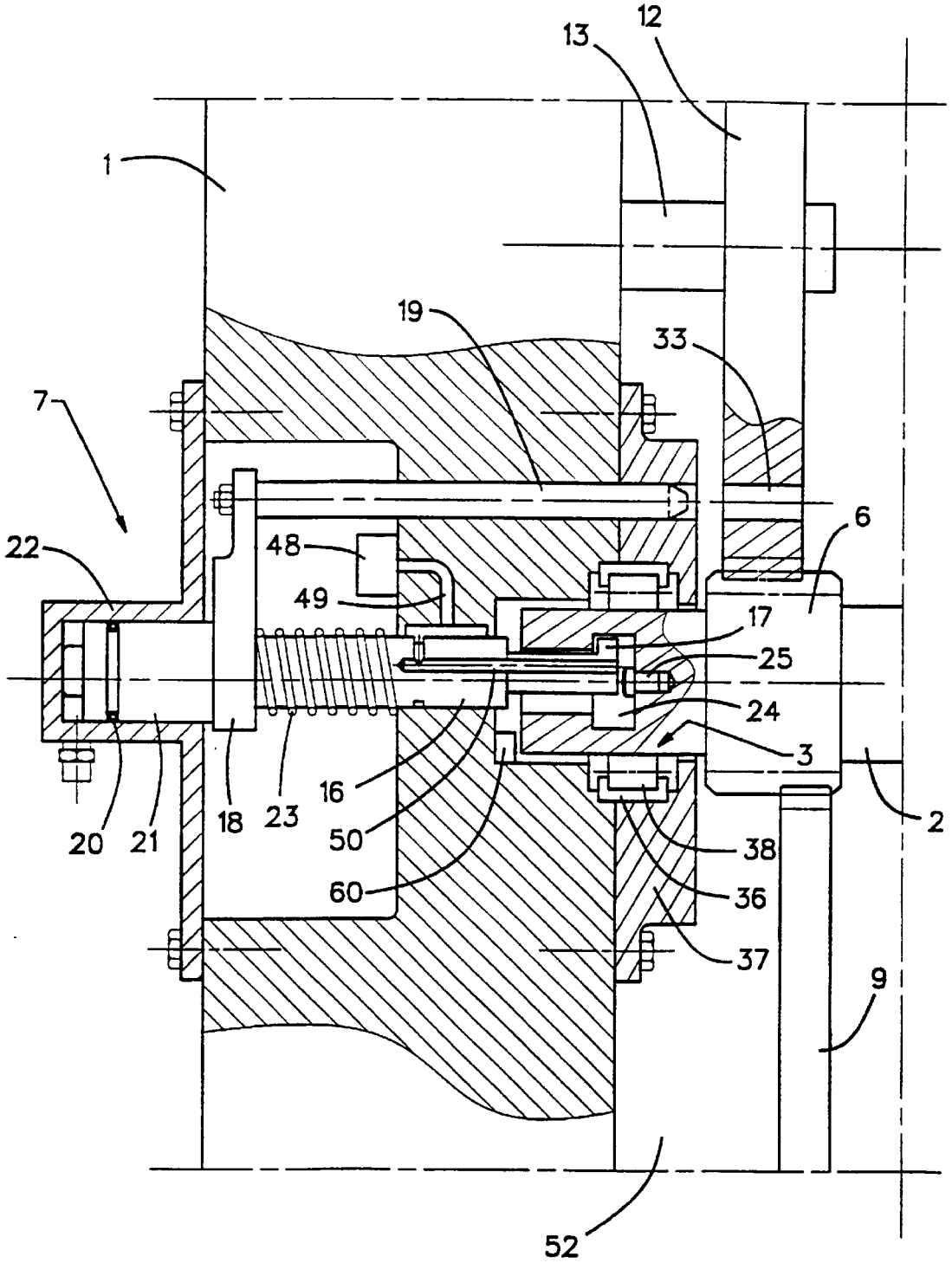
FIG. 5 shows detail the cutaway F5 of FIG. 1 on a larger scale.

The rod 19 of the shifting device 7 acts as a stop for the drive gear 12 (FIG. 5). At least one aperture 12 of the drive gear 12 is associated with the rod 19. To facilitate entry of the bolt 19 into an aperture 33, the end of the rod is beveled. The rod 19 is mounted in such manner relative to the rod 16 that it will not enter an aperture 33 in the drive gear 12 when in the position of FIG. 2 , but it will enter an aperture it in the position of FIG. 3. Preferably the rod 19 already cooperates with an aperture 33 before the switching gear wheel 6 separates from the drive gear 12, that is, before the main drive shaft 2 has reached the position of FIG. 3. This feature assures that the drive gear 12 already has been stopped when the switching gear wheel 6 and the drive gear 12 become disengaged. On the other hand, as regards this configuration, the bolt 19 no longer can cooperate with an aperture 33 when the switching gear wheel 6 and the drive gear 12 are engaged along a given width of the gear teeth. It is clear that in this embodiment every aperture 33 in the drive gear 12 is situated at a location associated with a clearance 30 whereby, when the rod 19 enters a clearance 33, a clearance 30 shall be opposite the switching gearwheel 6 which then is freely rotatable within this clearance 30.

The main drive shaft 2 supported by bearings 3 and 4 in the loom frame 1 is simultaneously the shaft of the drive motor 5. As shown by FIGS. 2, 3 and 5, the bearings 3 and 4 each are fitted with an outer race 36, 39 affixed between the loom frame 1 and resp. a flange 37,41 fastened by screws to the loom frame 1. Several bearing rollers, for instance cylindrical rollers 38, 40, run in the outer races 36, 39 of the bearings 3, 4 and directly on the main drive shaft 2. In this region the main drive shaft 2 is hardened, for instance by heat hardening. With the rollers 38, 40 directly cooperating with the main drive shaft 2, the number of necessary parts is reduced. Also the axial displace ability of the main drive shaft 2 is enabled.

The rotor 42 of the drive motor 5 is mounted on the main drive shaft 2, and preferably is rigidly affixed to it so that the rotor 42 and the main drive shaft 2 may be mutually shifted axially. The stator 44 of the drive motor 5 is held in a motor housing 43 and attached to the loom frame 1. In this embodiment the motor housing 43 is fitted with a threaded end 45 which is screwed into the threaded flange 41. The flange 41 is configured in such manner that the stator 44 is concentric with the rotor 42. The opposite end of the motor housing 43 also is fitted with a threaded end 46 onto which is threaded a flange 47 containing the shifting device 8. In accordance with another embodiment, fixing by threaded ends may be replaced by screw-tightened flange connections.

As shown, the stator 44 in both positions of FIGS. 1 and 3 encloses the major part of the rotor 42. In the positions shown in FIGS. 1 and 3, the main drive shaft 2 is located at either extreme axial position and thereby the stator 44 substantially encloses the rotor 42, and likewise when the rotor 42 is in an axial position in-between the extreme ones of FIGS. 1 and 3. As a result, the drive motor 5 always can apply a drive torque to the main drive shaft 2, regardless of the axial position of the main drive shaft 2.

The rotor 42 and the stator 44 are axially configured in such a way that if the drive motor 5 is energized when in the position of FIG. 1, which is that of the main drive shaft 2 during normal weaving, no axial electromagnetic forces, or practically none, are exerted by the stator 44 on the rotor 42. This means for instance that the rotor 42 must be positioned in the axial center of the stator 44 when the magnetic field lines are symmetric in the normal weaving position of the main drive shaft 2. Because electromagnetic forces arise between the stator 44 and the rotor 42 upon energizing the stator 44 of the drive motor 5 in the position of FIG. 3 and load the main drive shaft 2 in the position of FIG. 1, the shifting device 7 must be able to exert enough force to keep the main drive shaft 2 in the position of FIG. 3.

In the illustrated embodiment, the axial length of the rotor 42 equals that of the stator 44. In the position shown in FIG. 1, the rotor 42 and the stator 44 are exactly opposite each other and therefore no axial forces are exerted by the stator 44 on the rotor 42 when the motor 5 is energized. Because of the identical lengths of the rotor 42 and stator 44, the advantage is achieved that when the drive motor 5 is energized, a slight axial shift between the rotor 42 and the stator44 generates comparatively large axial forces which align the rotor 42 and the main drive shaft 2 relative to the stator44. Accordingly, during weaving, that is in the position of FIG. 1, the main drive shaft 2 is constrained by a comparatively large force to be located at a defined axial position and retained there so that the main drive shaft 2 will neither shift nor oscillate axially.

The drive system comprises a lubricating oil supply 48, shown in FIG. 5, which moves oil through conduits 49 and 50 and oil passages 51, 52, 53 (FIG. 1) in the loom frame 1 to the bearings 3 and 4 in order to lubricate the rollers 38, 40 and their outer races 36, 39 and the rollers 38, 40 relative to the main drive shaft 2. Oil seals (not shown) prevent the oil from leaking out of the passages 51, 52, 53. For example, the lubricating-oil supply 48 may correspond to the lubricating-oil circuit described in the European patent document A 0,726,345.

The drive motor 5 is a controlled motor, preferably with regard to its speed and/or its angular position and/or its drive torque and or its direction of rotation. Such control is carried out by the control unit 54 shown in FIG. 1. This control unit 54 receives commands from an input unit 55 that determine the starting or stopping, slow operation or filling finder motion of the loom, separation and then re-engagement at desired angular positions of the switching gear wheel 6 and the drive gear 12.

The drive system contains a sensor 56 cooperating with an encoding disk 57 illustratively mounted on the main drive shaft 2 and connected to the control unit 54 to detect the angular position of the main drive shaft 2. The sensor 56 is designed in such manner that it can cooperate with the encoding disk 57 at any axial position of the main drive shaft 2. Illustratively, the sensor 56 contains a photo-emitter 58 and a photo-detector 59 at a distance from each other larger than the axial shifting path of the main drive shaft 2. The encoding disk 57 is fitted, for instance, with apertures configured in a defined manner and through which pass light beams from the emitter 58 to the detector 59. Of course, in other embodiments, the sensors 56 may operate on different principles, for instance magnetic, electromagnetic, etc.

The determination of angular position of the main drive shaft is important for the mutual engagement and disengagement of the switching gear wheel 6 and drive gear 12. When the drive motor 5 is controllable, the determination of angular position of the main drive shaft is also important with regard to feedback control of angular position and/or speed and/or drive torque of the drive motor 5 using the control unit 54.

In this embodiment the control unit 54 furthermore is connected to proximity switches 60 and 61 associated with the main drive shaft 2. The proximity switch 60 detects whether the main drive shaft 2 is in the position of FIG. 1. It prevents the control unit 54 from starting the loom unless the main drive shaft 2 is in the position of FIG. 1. The proximity switch 61 detects whether the main drive shaft 2 is in the position as shown in FIG. 3. It then commands the control unit 54 to validate starting a filler finding motion. The proximity switch 60 moreover detects whether the switching gear wheel 6 again engages the drive gear 12 following a filling search.

The main drive shaft 2 is in the position shown in FIG. 1 during normal weaving. The drive motor 5 is actuated by the control unit 54 so that it runs at a predetermined weaving rate. If weaving must be slow, the drive motor 5 is commensurately controlled by the control unit 54. If the main drive shaft 2 must be stopped, the drive motor 5 is controlled by the control unit 54 to apply a braking torque to the main drive shaft 2. If a filling search must be carried out, the shifting devices 7 and 8 are controlled in an appropriate way such that the main drive shaft 2 is axially shifted into a position as shown in FIG. 3, whereby the switching gear wheel 6 is disengaged from the drive gear 12 at least with respect to the batten drive but remains engaged with respect to the gear 9 powering the shed-forming drive. Thereupon, the drive motor 5 is so controlled by the control unit 54 that when a filling search displacement at low speed is carried out, the drive gear 9 is actuated until a filling has been released from the shed forming means. Then the drive motor 5 is controlled in such a way that the main drive shaft 2 is returned to the same angular position as before the filling search. In this angular position the switching gear wheel 6 is caused to again engage the drive gear 12 by axially shifting the main drive shaft 2 by the shifting devices 7 and 8 into the position shown in FIG. 1. Thereafter, normal weaving may be resumed.

Figure 6:
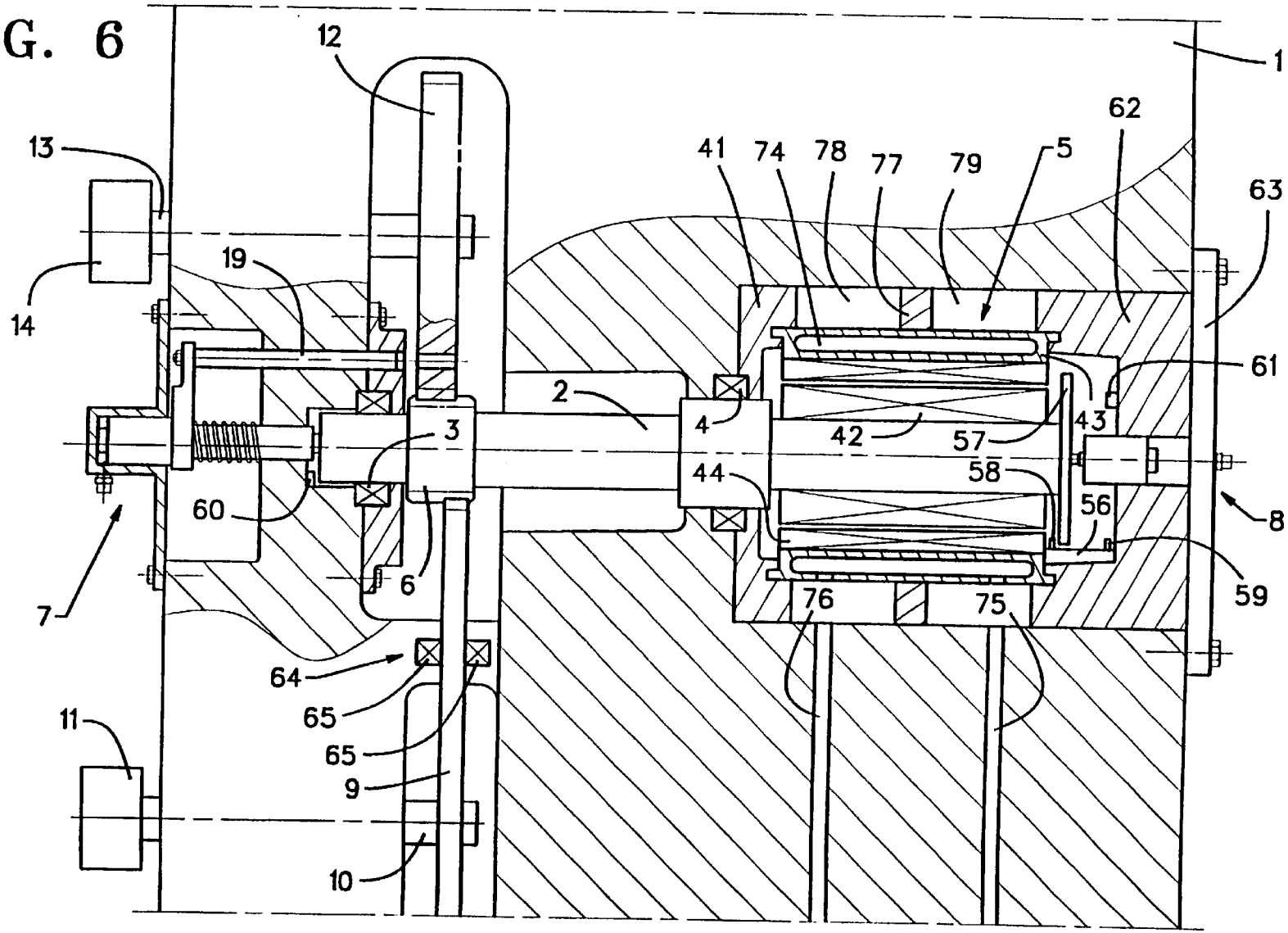
FIG. 6 is partial section view of a different embodiment of a drive system according to the invention.
Figure 7:
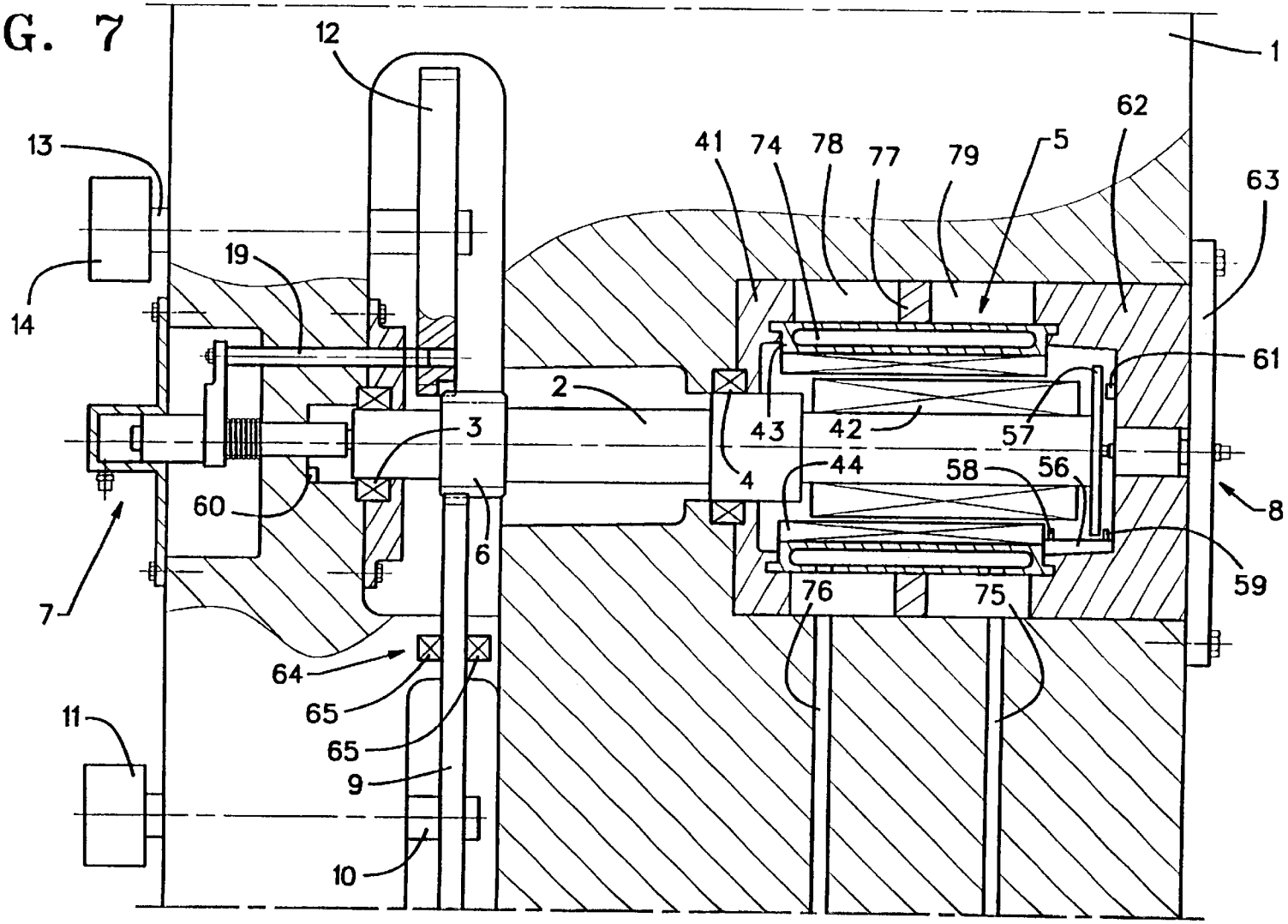
FIG. 7 shows the embodiment of FIG. 6 with the main drive shaft at a second position.

FIGS. 6 and 7 show an embodiment similar to that of FIG. 1 wherein, however, the drive motor 5 is mounted within the loom frame 1. In the loom frame 1, a flange 41 is mounted on the bearing 4 to which the motor housing 43, together with the stator 44, will be secured. A clamp 62 that houses the shifting device 8 is mounted between the motor housing 43 and the outside of the loom frame 1. A flange 63 is secured to the outside of the loom frame 1 and holds the clamp 62 against the motor housing 43 and the housing 43 against the flange 41.

Even though a brake torque may be applied using a controllable drive motor 5, the embodiment of FIGS. 6 and 7 additionally provides a brake 64 to stop the loom. The brake 64 illustratively comprises brake shoes 65 acting against the sides of the drive gear 9 that functions as a brake disk. This brake 64 may be engaged at every loom stoppage to prevent the main drive shaft 2 from rotating during such a stoppage. Using a brake 64 cooperating with the drive gear 9 offers the advantage that this brake can be activated with the position of the main drive shaft 2 as shown in FIGS. 2 through 6 and likewise as shown in FIG. 7.

The brake 64 may be driven by hydraulic or electromagnetic means (not shown). In the latter case the brake shoes 65 are moved into a braking position by springs, for instance, and are moved out of braking position electromagnetically, so that, in the event of power failure, the loom will be braked and held in the braked position.

When the main drive shaft 2 is in the position shown in FIG. 7, the rotor 42 and the stator 44 are mutually offset in the axial direction. However, because the stator 44 substantially encloses the rotor 42, even in the position of FIG. 7, a drive torque can be exerted by the drive motor 5 on the main drive shaft 2. If a brake 64 is provided and if, during normal weaving with the main drive shaft 2 in the position shown in FIG. 6 the rotor 42 and the stator 44 are configured in such a way that no electromagnetic forces are exerted by the stator 44 on the rotor 42 when the drive motor 5 is energized, then the shifting device 8 may be eliminated. In such a case the axially acting electromagnetic forces effective in the position of FIG. 7 when the drive motor 5 is energized are able to axially shift the main drive shaft 2. Because the main drive shaft 2 is still locked by the brake 64, the switching gear wheel 6 and the drive gear 12 can then be made to engage.

Clearances 74 for circulating a coolant are present in the motor housing 43 shown in FIGS. 6 and 7. The coolant is supplied from a reservoir (not shown) through a feed line 75 and is drained through an exhaust conduit 76 to a discharge (not shown). Two ducts 78 and 79 separated by a partition 77 are provided between the motor housing 43 and the loom frame 1 to allow the coolant to return to the clearances 74. The coolant may be in the form of a lubricant or water or any other cooling medium, such as compressed air. Seals are provided to prevent the coolant from leaking and thereby reach, for instance, the stator 44, the rotor 42 or the main drive shaft 2. The stator 44 of the drive motor is cooled in this manner. Moreover, means may be provided to cool the rotor also, for instance by using air. When heat is dissipated at the stator 44, cooling of the stator alone generally will suffice.

Figure 8:
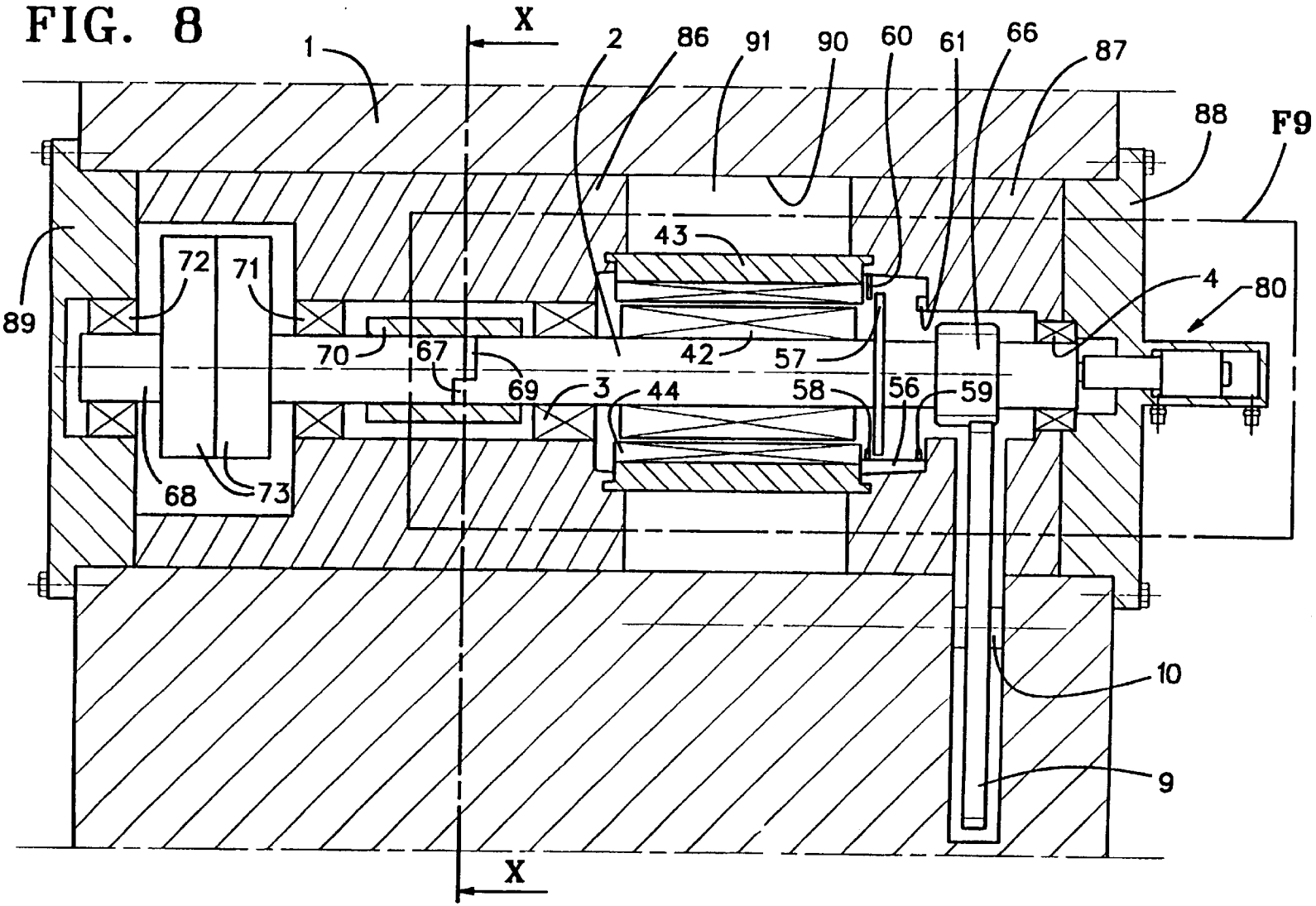
FIG. 8 is a section view of another embodiment of a drive system of the invention.
Figure 9:
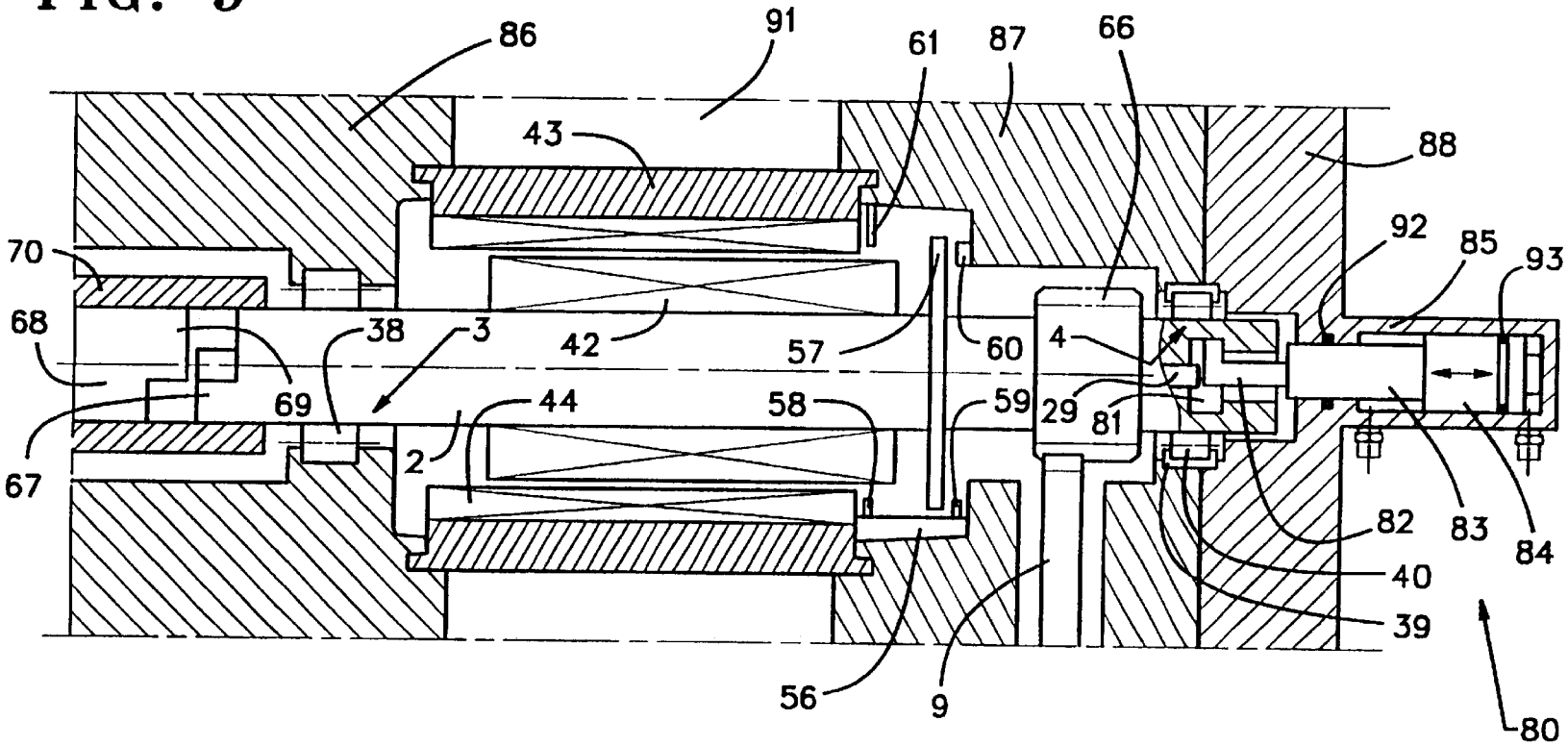
FIG. 9 shows detail F9 of the embodiment of FIG. 8 on a larger scale and in another position of the main drive shaft.
Figure 10:
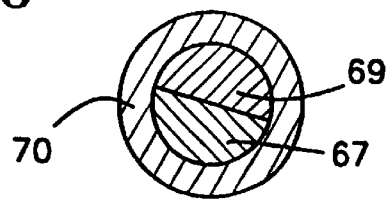
FIG. 10 is a partial section view taken along line X—X of FIG. 8.

As regards the embodiment shown in FIGS. 8 through 10, the main drive shaft 2 is supported in the manner described in the above described embodiments by means of bearings 3 and 4 in loom frame 1. The rotor 42 of the main drive motor is mounted on the main drive shaft 2 between the bearings 3 and 4. The motor housing 43 together with the stator 44 is so configured within the loom frame 1 that the stator 44 substantially encloses the rotor 42 at any of the possible axial positions. The axially displaceable main drive shaft 2 is fitted with a gear 66 engaging a drive gear 9 that activates other drive elements including the shed forming drive system. The end of the main drive shaft 2 opposite the end on which gear 66 is fitted with a coupling element 67. This coupling element 67 is formed by milling out part of the main drive shaft 2.

In this embodiment the rotor 42 and the stator 44 have different lengths. The stator 44 is somewhat longer, for instance by a few mm, than the rotor 42. Because the rotor 42 and the stator 44 are not exactly the same length, the axial electromagnetic forces which, upon energization of the drive motor 5, drive the rotor 42 towards the middle of the stator 44, are smaller than when the rotor 42 and the stator 44 are of equal lengths.

The axially displaceable main drive shaft 2 can be shifted in both directions by means of a shifting device 80. The main drive shaft 2 includes an axial clearance fitted with an annular slot 81. A hook 82 mounted on a rod 83 extends into this annular slot 81. At the end located away from the hook 82, the rod 83 defines a piston 84 guided inside a cylinder 85. The cylinder 85 is dual acting and can be reciprocated by a hydraulic or pneumatic control device (not shown). The rod 83 is sealed in the vicinity of the hook 82 by a sealing ring 92 inserted into a flange 88. A sealing ring, for instance an O ring 93, is mounted on the piston 84 and seals the latter relative to the cylinder 85. Like the previous embodiments, an encoding disk 57 is mounted on the main drive shaft 2 and cooperates with a sensor 56 containing a photo-emitter 58 and a photo-detector 59. Also, proximity switches 60 and 61 cooperate with the encoding disk 57 to detect the particular extreme axial positions of the main drive shaft 2.

A second shaft 68 is supported in the loom frame 1 coaxially with the main drive shaft 2. This shaft 68 comprises a coupling element 69 corresponding to the coupling element 67. FIG. 10 shows the shape of the coupling elements 67 and 69. A guide element 70 is secured to the shaft 68 and allows axial displacement of the main drive shaft 2 inside this element. The purpose of the guide element 70 is to keep the main drive shaft 2 and the shaft 68 mutually aligned. The shaft 68 is supported by bearings 71, 72 in the loom frame 1 and a system 73 of several cams cooperates with cam slides (not shown). These cam slides are mounted on the loom's batten shaft.

The bearing 3 of the main drive shaft 2 is supported by a spacer 86 in the loom frame 1. In this embodiment, the spacer 86 is fitted with an annular slot that defines an external bearing race and therefore a separate race for the bearing 3 is unnecessary. The outer race 39 of the bearing 4 is fixed by a clamp 87 and a flange 88 to the loom frame 1. The shifting device 80 is seated in this flange 88. The bearing 71 is held by a press-fit in the spacer 86 and on the shaft 68. The bearing 72 is press-fitted in a flange 89 fixed to the loom frame 1. The motor housing 43 is clamped between the spacer 86 and the clamp 87 because the flanges 88 and 89 are fixed to the loom frame 1. The spacer 86 and the spacer 87 as well as parts of the flanges 88 and 89 are inserted into a borehole 90 of the loom frame 1. A chamber 91 is provided in the borehole 90 between the spacer 86 and the clamp 87 near the motor housing 43 to pass coolant in a manner similar to that described in connection with FIGS. 6 and 7.

In the position shown in FIG. 8, the main drive shaft 2 drives both the drive gear 9 and the cam system 73. The main drive shaft 2 in this position is powered at the normal weaving rate or at a lesser speed for slow operation. If a filling search must be carried out, the main drive shaft 2 is shifted into the position of FIG. 9 while the coupling elements 67 and 69 are separated. Thereafter only the drive gear 9 will be connected to the main drive shaft 2 and as a result a so-called filling search displacement can be carried out. If weaving is to resume, the main drive shaft 2 is shifted back into the position of FIG. 8. The drive shaft 68 is locked into its angular position by appropriate means (not shown) during the filling search.

This inventive design of a loom drive system requires fewer parts than conventional designs and the energy losses are thus comparatively low. Fewer friction-creating bearings are needed. Moreover, transmission elements between the drive motor and the main drive shaft, such as belt or chain transmissions that cause energy losses and are subject to wear and hence require maintenance, are eliminated. The drive system of the invention furthermore is capable of transmitting large torques required when the loom is to be operated at slow rates, that is when the main drive shaft 2 is run at a slower speed.

The design as a whole requires comparatively few oil seals cooperating with a rotating shaft and hence entails lower energy losses. The rotating main drive shaft 2 requires few if any oil seals, that is, a borehole may be present at the bottom of and in the flange 41 to drain oil that might flow from the passages 51, 52, 53 toward the drive motor 5. However, an oil seal may be provided for safety beyond the bearing 4 as seen in the direction toward the drive motor 5 as illustrated.

The invention is not restricted to the shown and described illustrative embodiments. In particular features of one embodiment may be combined with those of another. Illustratively, the brake 64 described in relation to FIGS. 6 and 7 also may be used in the embodiment of FIGS. 1 through 5 or in that of FIGS. 8 through 10. Furthermore the main drive shaft 2 described as being integral in the embodiments might be formed of two or more parts. Again, the main drive shaft need not be integral with or be a component of a motor shaft. In particular, a drive motor shaft might be connected by a coupling directly to the main drive shaft 2, such coupling allowing axial shifting but enabling angular ganging in the circumferential direction, for instance forming a coupling 67, 69, 70 corresponding to the embodiment of FIGS. 8 through 10, between the main drive shaft 2 and the shaft 68.

What is claimed is:

1. A loom drive system comprising:

a loom frame (1);

a drive motor (5); having a drive shaft a main drive shaft (2) driven by the drive motor (5) and supported in the loom frame (1); and the drive motor (5) is coaxial with the main drive shaft (2) and is directly connected to the main drive shaft (2).

2. The drive system as claimed in claim 1, wherein the drive motor (5) comprises a shaft, and the main drive shaft (2) is the shaft of the drive motor (5).

3. The drive system as claimed in claim 1, wherein the main drive shaft (2) is fitted with an axial extension entering a motor housing (43) of the drive motor (5), said housing being mounted on or in the loom frame (1).

4. The drive system as claimed in claim 1, wherein the main drive shaft (2) is supported between two bearings (3, 4) in the loom frame (1) and is partially enclosed by a motor housing (43) of the drive motor (5), and the motor housing (43) is mounted in the loom frame (1).

5. The drive system as claimed in claim 1, wherein the main drive shaft (2) is connected to at least two drive elements (9, 12; 9, 68) of which one of the drive elements (12, 68) is disengageable from the main drive shaft (2).

6. The drive system as claimed in claim 1, wherein the main drive shaft (2) is connected to at least two drive elements (9, 12; 9, 68) of which one of the drive elements (12, 68) is disengageable from the main drive shaft (2), and the main drive shaft (2) is supported in axially displaceable manner and can be shifted by shifting devices (7, 8, 80) between a first position whereat the main drive shaft (2) engages both of the drive elements (9, 12; 9, 68) and a second position whereat the main drive shaft (2) engages only one of the drive elements (9).

7. The drive system as claimed in claim 1, wherein the main drive shaft (2) is supported in the loom frame (1) by roller bearings (3, 4) each comprising an outer race (36, 39) and a roller (38, 40).

8. The drive system as claimed in claim 6, wherein the drive elements (9, 12; 68) comprise drive gears, and the main drive shaft (2) is axially displaceable and fitted with a switching gear wheel (6) rigidly joined to the main drive shaft (2) at its axial and circumferential directions and which, in the first position the main drive shaft (2) engages at least two drive gears (9, 12) and in the second position the main drive shaft (2) engages only one of the drive gears (9).

9. The drive system as claimed in claim 1, wherein the drive motor (5) comprises a rotor (42) which is mounted on the main drive shaft (2) and together with the main drive shaft (2), is axially displaceable relative to an associated stationary stator (44).

10. The drive system as claimed in claim 9, wherein the main drive shaft (2) is connected to at least two drive elements (9, 12; 9, 68) of which one of the drive elements (12, 68) is disengageable from the main drive shaft (2), and longitudinal centers of the rotor (42) and the stator (44) lie substantially in a common radial plane at a position where the main drive shaft (2) engages both of the drive elements (9, 12; 9, 68).

11. The drive system as claimed in claim 1, further comprising a detecting device (56, 57, 58, 59, 60, 61) associated with the main drive shaft (2) and configured for detecting angular position and/or axial position of the main drive shaft (2).

12. The drive system as claimed in claim 5, further comprising a switchable stop (19, 33) or brake system (64) that is associated with the drive element (12, 68) and is engageable with the main drive shaft (2) or the drive element (9) that permanently engages the main drive shaft (2).

13. The drive system as claimed in claim 1, wherein angular speed and/or angular position and/or drive torque and/or direction of rotation of the drive motor (5) can be controlled by a control device.

* * * * *